US011673774B2

(12) United States Patent
Zhang et al.

(10) Patent No.: US 11,673,774 B2
(45) Date of Patent: Jun. 13, 2023

(54) ELEVATOR SYSTEM AND SUPPORTING COLUMN ASSEMBLY THEREOF

(71) Applicant: Otis Elevator Company, Farmington, CT (US)

(72) Inventors: Zhe Zhang, Tianjin (CN); Hong Fu, Tianjin (CN); Zhixue Li, Tianjin (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 17/385,165

(22) Filed: Jul. 26, 2021

(65) Prior Publication Data

US 2022/0048737 A1 Feb. 17, 2022

(30) Foreign Application Priority Data

Aug. 12, 2020 (CN) ..... 202010805816.7

(51) Int. Cl.

| | |
|---|---|
| ***B66B 11/00*** | (2006.01) |
| ***B66B 7/02*** | (2006.01) |
| ***B66B 9/00*** | (2006.01) |
| ***B66B 11/02*** | (2006.01) |
| ***B66B 11/04*** | (2006.01) |
| ***B66B 13/00*** | (2006.01) |

(52) U.S. Cl.

CPC ..... *B66B 11/00* (2013.01); *B66B 7/02* (2013.01); *B66B 9/00* (2013.01); *B66B 11/004* (2013.01); *B66B 11/0206* (2013.01); *B66B 11/0226* (2013.01); *B66B 11/043* (2013.01); *B66B 13/00* (2013.01)

(58) Field of Classification Search

CPC ... B66B 11/0453; B66B 7/022; B66B 11/043; B66B 7/02; B66B 7/021; B66B 7/028; B66B 9/025; B66B 2009/006; B66B 11/004; B66B 11/005

See application file for complete search history.

(56) References Cited

FOREIGN PATENT DOCUMENTS

| | | | | | |
|---|---|---|---|---|---|
| CA | 2769542 | A1 | * | 8/2013 | ..... B66B 11/02 |
| CN | 104860156 | A | * | 8/2015 | |
| CN | 109132795 | A | * | 1/2019 | ..... B66B 11/0446 |
| CN | 210260777 | U | * | 4/2020 | |
| CN | 109292589 | B | * | 5/2020 | ..... B66B 1/3492 |
| CN | 112551314 | A | * | 3/2021 | ..... B66B 11/0206 |

OTHER PUBLICATIONS

English Machine Translation of CN 21026077.*

* cited by examiner

*Primary Examiner* — Diem M Tran
(74) *Attorney, Agent, or Firm* — Cantor Colburn LLP

(57) ABSTRACT

An elevator system and a support column assembly. The elevator system includes a support column, with the bottom end thereof connected to a bottom mounting base, and the top end thereof connected to a top mounting base; a counterweight arranged in the support column; a car having a through hole penetrating in a vertical direction, wherein the car is arranged around the support column via the through hole; and a traction assembly, wherein the car is connected to the counterweight via the traction assembly, and the car and the counterweight reciprocate along the length direction of the support column under the traction of the traction assembly.

15 Claims, 8 Drawing Sheets

ELEVATOR SYSTEM AND SUPPORTING COLUMN ASSEMBLY THEREOF

FOREIGN PRIORITY

This application claims priority to Chinese Patent Application No. 202010805816.7, filed Aug. 12, 2020, and all the benefits accruing therefrom under 35 U.S.C. § 119, the contents of which in its entirety are herein incorporated by reference.

TECHNICAL FIELD

The present application relates to the field of elevator. More specifically, the present application relates to a support column arrangement scheme for an elevator system.

BACKGROUND

As a tool to facilitate passengers' walking between floors or shorten passengers' walking distance, passenger transportation devices are very common in daily life. As an example, the most commonly seen ones are escalators and elevators usually used between the floors of commercial buildings, and moving walkways usually used in large airports.

For an elevator system, it usually needs to set up a dedicated hoistway to install various components, including: a car running in the hoistway and a counterweight that achieves force balance with the car. In addition, considering that the elevator car should run between floors in the desired directions, the hoistway that houses the elevator car to run is usually enclosed by walls integrally formed with the building, and guide rails are usually set on the walls to guide the operation of the elevator car. Therefore, the car arrangement of the elevator system is usually determined when the building is built. In addition, for a current sightseeing elevator, since it needs to partially lean against the building walls, it can only provide sightseeing with a partial view angle.

SUMMARY

The present application provides a truss assembly to at least partially reduce the requirements on the buildings for the installation and arrangement of an elevator system. The present application also provides an elevator system to reduce the requirements on the buildings for its installation and arrangement, and to provide a broader angle of view for sightseeing.

To achieve at least one objective of the present application, according to one aspect of the present application, an elevator system is provided, which comprises: a support column, with the bottom end thereof connected to a bottom mounting base, and the top end thereof connected to a top mounting base; a counterweight arranged in the support column; a car having a through hole penetrating in a vertical direction, wherein the car is arranged around the support column via the through hole; and a traction assembly, wherein the car is connected to the counterweight via the traction assembly, and the car and the counterweight reciprocate along the length direction of the support column under the traction of the traction assembly.

In addition to one or more of the above features, or as an alternative, in another embodiment, the support column is configured as a truss.

In addition to one or more of the above features, or as an alternative, in another embodiment, the car has an outer wall disposed away from the support column, wherein the outer wall is made of a transparent material.

In addition to one or more of the above features, or as an alternative, another embodiment further comprises: a bottom beam support and a vertical beam support. The bottom beam support is arranged at the bottom of the car. The vertical beam support passes through the through hole of the car, and is respectively connected to the bottom beam support and the traction assembly.

In addition to one or more of the above features, or as an alternative, in another embodiment, a plurality of vertical beam supports are provided, and the traction assembly comprises a plurality of sets of traction machines, a plurality of traction fixed pulleys and a plurality of traction reverse wheels; wherein, a plurality of the traction wheels are evenly arranged above the car in a circumferential direction and are respectively connected to a plurality of the vertical beam supports.

In addition to one or more of the above features, or as an alternative, in another embodiment, the traction ratio of each set of the traction machine is 4:1 or 2:1.

In addition to one or more of the above features, or as an alternative, another embodiment further includes: a car guiding element, fixedly arranged between the support column and the car along the length direction of the support column, and used to guide the reciprocating movement of the car.

In addition to one or more of the above features, or as an alternative, another embodiment further includes: a counterweight guiding element, fixedly arranged between the support column and the counterweight along the length direction of the support column, and used to guide the reciprocating movement of the counterweight.

In addition to one or more of the above features, or as an alternative, in another embodiment, the car guiding element and the counterweight guiding element are arranged crosswise on the support column.

In addition to one or more of the above features, or as an alternative, in another embodiment, the support column has a rectangular cross section perpendicular to its length direction; wherein, the car guiding element is arranged on the short side of the rectangular cross section of the support column and extends and protrudes outwardly; the counterweight guiding element is arranged on the long side of the rectangular cross section of the support column and extends and protrudes inwardly.

In addition to one or more of the above features, or as an alternative, another embodiment further includes: a shield, arranged between the support column and the through hole of the car, and dads the support column.

In addition to one or more of the above features, or as an alternative, in another embodiment, the car has an inner wall disposed close to the support column and enclosed to form the through hole, wherein, one or more elevator operation panels are arranged on the inner wall.

In addition to one or more of the above features, or as an alternative, in another embodiment, the car has a plurality of car doors arranged around it.

In order to achieve at least one objective of the present application, according to another aspect of the present application, a support column assembly is provided for guiding the movement of a car in an elevator system. The support column assembly comprises: a support column, with the bottom end thereof connected to a mounting base, and the top end thereof connected to a traction machine room;

and a counterweight, arranged in the support column and reciprocating along the length direction of the support column when being hauled.

In addition to one or more of the above features, or as an alternative, another embodiment further comprises: a counterweight guiding element, fixedly arranged between the support column and the counterweight along the length direction of the support column, and used to guide the reciprocating movement of the counterweight.

In addition to one or more of the above features, or as an alternative, another embodiment further comprises: a counterweight support and a plurality of counterweight sheets, wherein the counterweight support is used to carry and restrain a plurality of mutually stacked counterweight sheets.

In addition to one or more of the above features, or as an alternative, in another embodiment, the support column is configured as a truss.

According to the support column assembly and the elevator system of the present application, by providing the support column assembly as the movement guiding element of the elevator car, since it is no longer dependent on the wall surface in the installation environment, a dedicated elevator hoistway specially set up against the walls in the building for the elevator car is no longer needed. The improved elevator system can be applied to any environment with through holes in the building, so its applicability is greatly improved. It also provides a technical basis for multi-compartment shared elevators on the same floor. In addition, since it supports the car only by the support column disposed inside the car, it also provides technical support for its realization of panoramic sightseeing.

DETAILED DESCRIPTION

Figure 1:
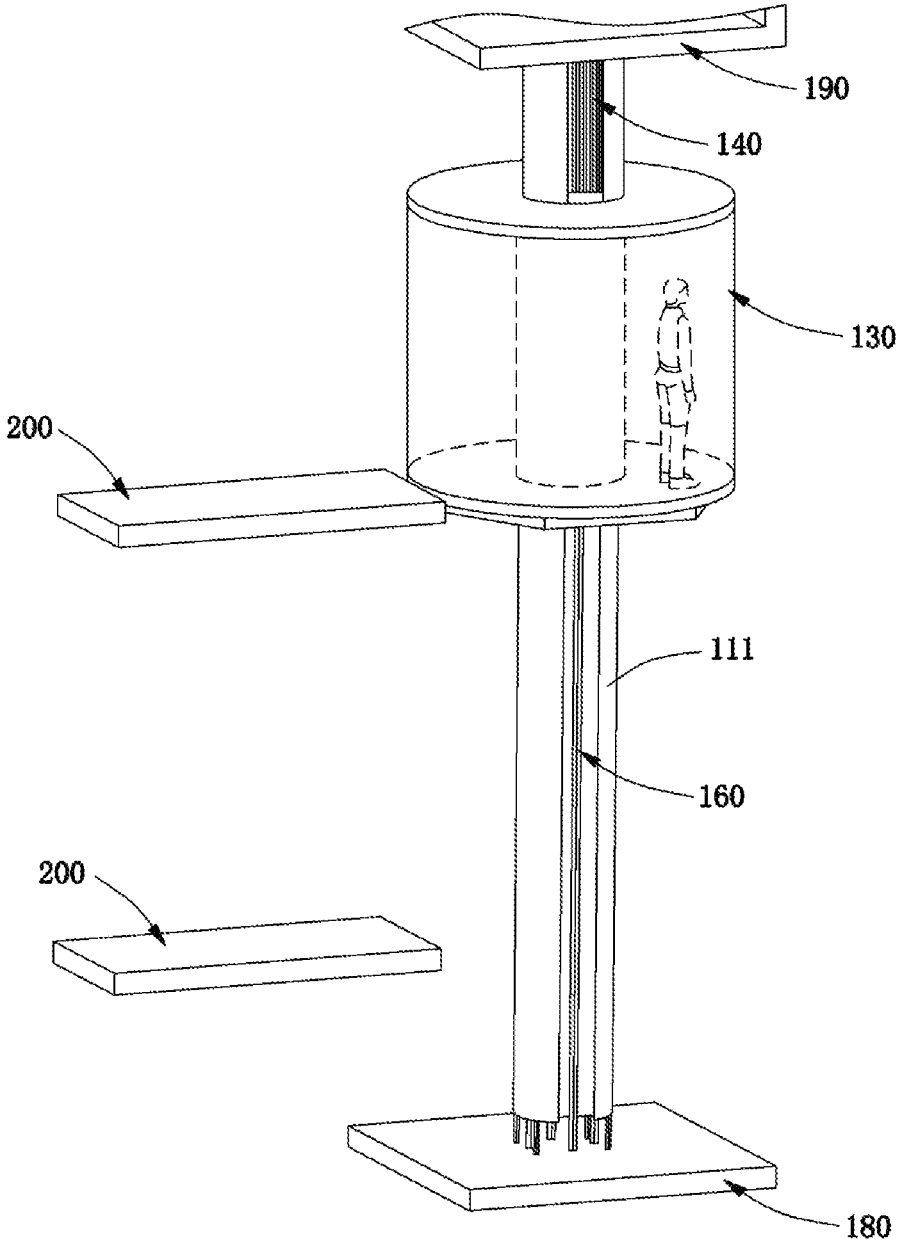
FIG. 1 is a perspective schematic view of an embodiment of an elevator system in which the truss is cladded.

The present application will be described in detail hereinafter by referring to the exemplary embodiments shown in the accompanying drawings. However, it should be understood that the present application can be implemented in many different forms, and should not be construed as being limited to the embodiments set forth herein. These embodiments are provided here for the purpose of making the disclosure of the present application more complete and comprehensive, and fully conveying the concept of the present application to those skilled in the art.

In addition, for any single technical feature described or implied in the embodiments mentioned herein, or any single technical feature displayed or implied in each drawing, the present application still allows any continued arbitrary combination or deletion of these technical features (or the equivalents thereof) without any technical obstacles, thereby obtaining more other embodiments of the present application that may not be directly mentioned herein.

The present application first describes herein an embodiment of an elevator system with reference to FIGS. 1 to 5. The elevator system 100 comprises a truss 110, a counterweight 120 arranged in the truss 110, and a car 130 arranged around the truss 110. The two ends of the truss 110 are respectively supported on a bottom mounting base 180 and a top mounting base (not shown in the figure), and are disposed close to a traction machine room 190. The car 130 and the counterweight 120 are connected to each other via a traction assembly 140 arranged in the traction machine room 190. Under the traction of the traction assembly 140, the car 130 and the counterweight 120 can reciprocate along the length direction of the truss 110, thereby transporting passengers to destination 200 where they expect to arrive at, so as to achieve the transporting function of the elevator system. The elevator system with such a configuration, on the one hand, by providing the truss 110 as the movement guiding element of the elevator car 130, no longer requires a dedicated elevator hoistway in the building for the elevator car 130, since it is no longer dependent on the wall surface in the installation environment. The improved elevator system 100 can be applied to any environment with vertical through holes in a building, thus greatly improving its applicability. On the other hand, the elevator system with such a configuration has the layout of the car surrounding the truss, so that its entire outer circumference can be used to set up car doors, thereby providing a technical basis for multi-compartment shared elevators on the same floor. In addition, since it supports the car only by the support column disposed inside the car, it also provides technical support for its realization of panoramic sightseeing.

It should be understood that, although guiding the car is specifically implemented by using the truss 110 for support as described herein in conjunction with the drawings, it can also be implemented in other structural forms with sufficient structural strength, rigidity and cost applicability, such as a column formed by thin walls. In this case, it still has more flexibility than the dedicated hoistway walls installed in the building.

Figure 2:
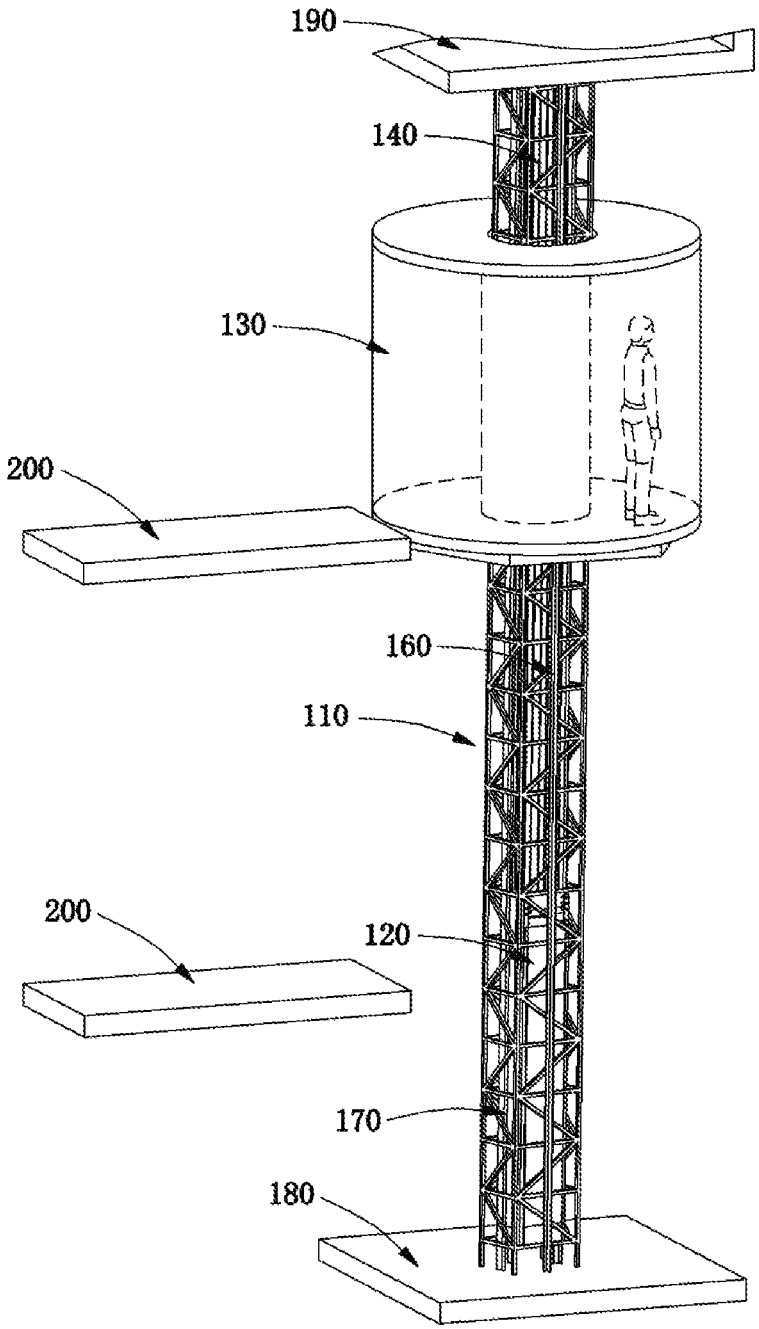
FIG. 2 is a perspective schematic view of an embodiment of an elevator system in which the truss is exposed.

Referring to FIGS. 1 and 2, the elevator system 100 is illustrated in its entirety. The difference is that: the truss in FIG. 1 is cladded by a shield 111, which can avoid the interference from all kinds of dust or other undesired factors to the counterweight and some parts of the traction assembly disposed in the truss during operation; whereas, the truss in FIG. 2 is exposed, which can facilitate a clearer observation of the operation of the built-in components and achieve rapid inspection and maintenance.

Figure 3:
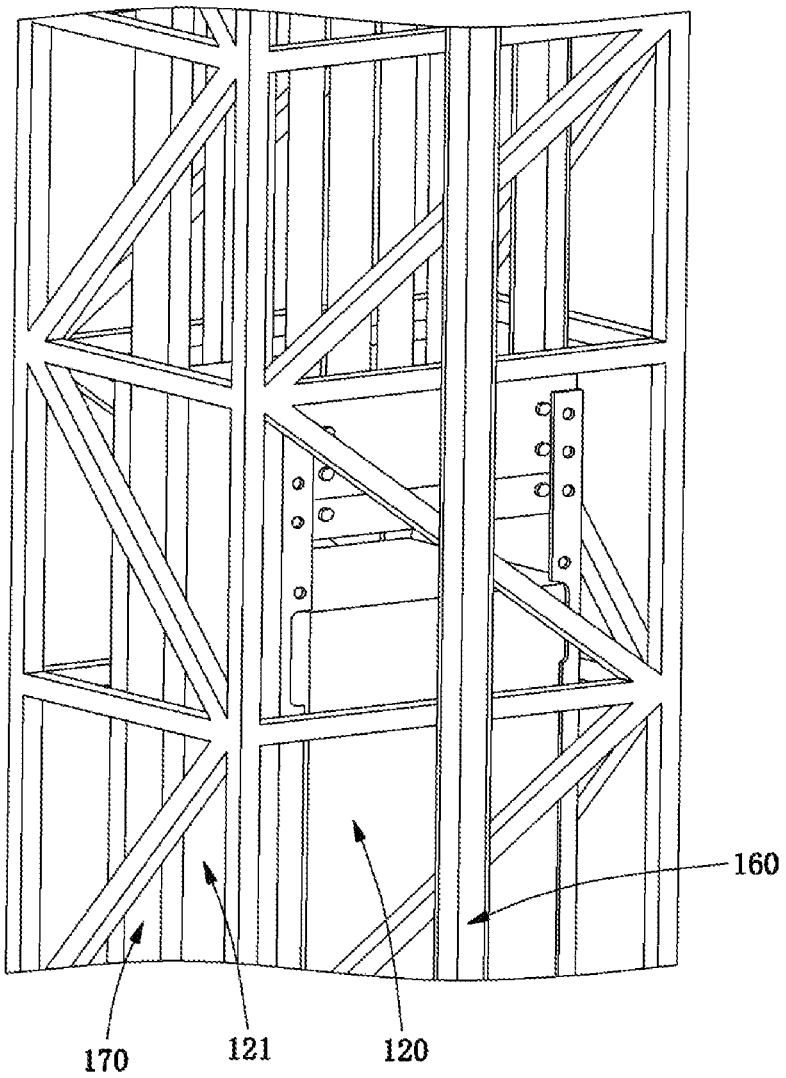
FIG. 3 is a partial enlarged schematic view of the counterweight and part of the truss in FIG. 2.

Continuing to refer to FIG. 3, the counterweight and part of the truss in FIG. 2 are partially enlarged. It can be seen from the figure that the aforementioned counterweight 120 comprises a counterweight support 121 and a plurality of counterweight sheets. Among them, the counterweight support 121 can be used to carry and restrain a plurality of mutually stacked counterweight sheets. This configuration improves the flexibility of counterweight configuration. The number of counterweight sheets can be adjusted according to the actual needs of the corresponding elevator system, and the counterweight support 121 can be fixed to form a complete and integrated counterweight.

In addition, FIG. 3 shows a counterweight guiding element 170 for guiding the movement direction of the counterweight 120, which is symmetrically fixed on the truss 110 along the length direction of the truss 110. In this way, the counterweight 120 can be guided during its reciprocating movement, thereby avoiding collision with the truss and causing undesired wear or damage. FIG. 3 also shows a car guiding element 160 for guiding the movement direction of the car 130, which is also symmetrically fixed on the truss 110 along the length direction of the truss 110. In this way, the car 130 can be guided during its reciprocating movement, thereby avoiding collision with the truss and causing undesirable wear or damage.

In order to simultaneously arrange two types of guiding elements on the truss 110 and avoid interference therebetween in the operating process, the two can be arranged crosswise on the truss 110. More specifically, taking the illustrated truss 110 having a rectangular cross section perpendicular to its length direction as an example, the car guiding element 160 can be arranged on the short side of the rectangular cross section of the truss 110, forming guide rails that extends and protrudes outwardly to guide the movement of the car and prevent it from colliding with the truss 110. At the same time, the counterweight guiding element 170 is arranged on the long side of the rectangular cross section of the truss 110, forming guide rails that extends and protrudes inwardly to guide the movement of the car and prevent it from colliding with the truss 110.

Referring again to FIG. 4, the elevator is illustrated from a top view. As can be seen from the figure, in the elevator system with this configuration, almost all the involved parts are arranged inside the car, or even arranged inside the truss, which makes a further contribution to the compactness of the elevator system.

Figure 4:
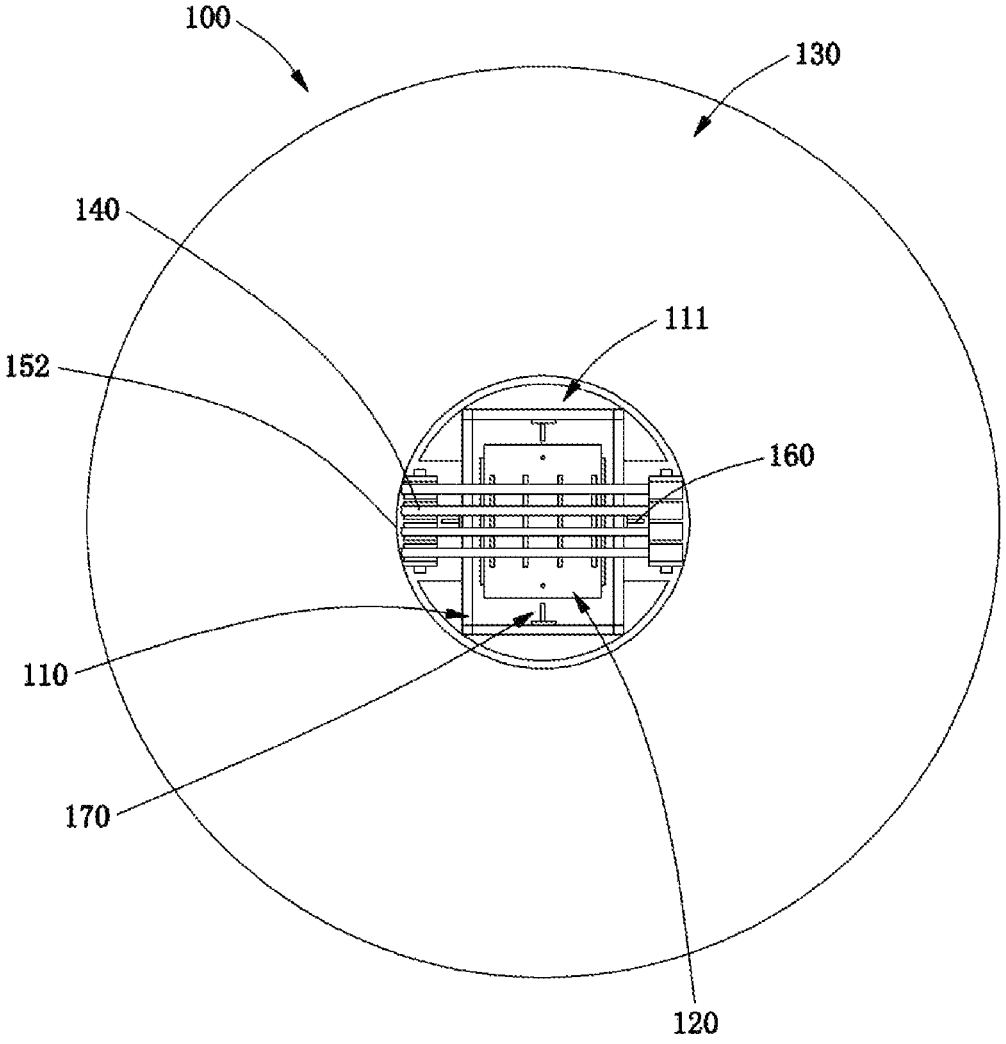
FIG. 4 is a schematic top view of an embodiment of the elevator system of FIG. 1.
Figure 5:
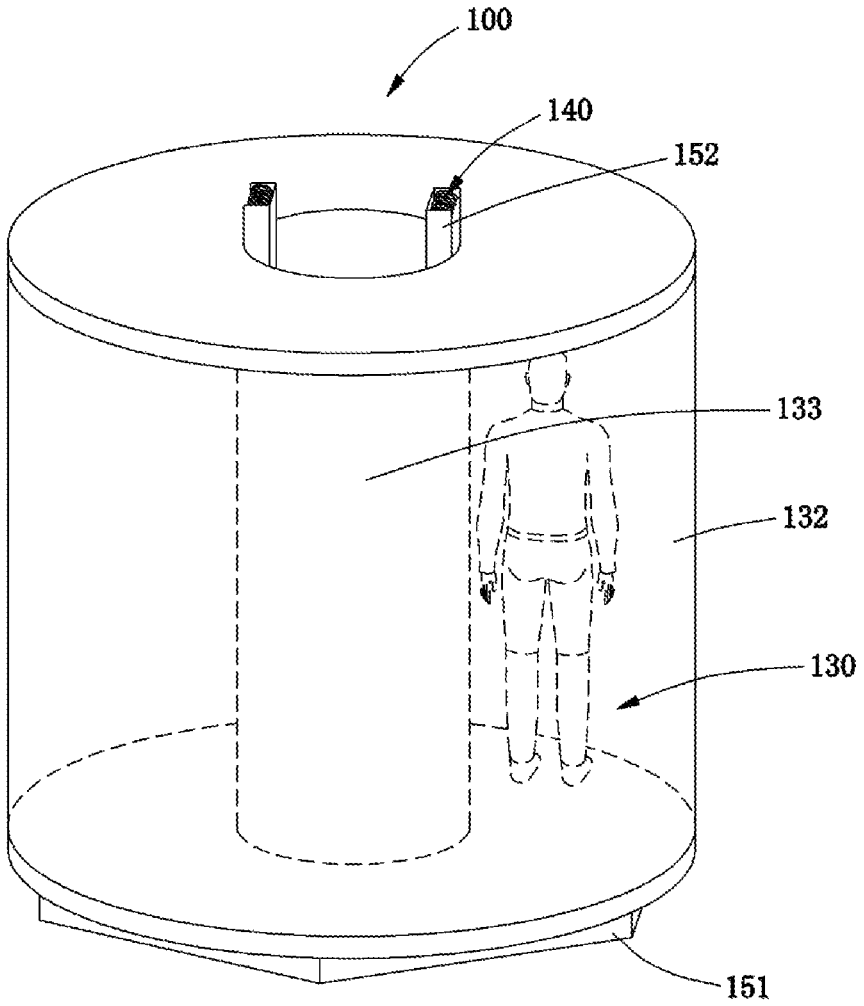
FIG. 5 is a perspective schematic view of a car of an embodiment of an elevator system.

Turning to refer to FIGS. 4 and 5, the car and its associated components in the elevator system are emphatically illustrated. Specifically, in order to realize the surrounding arrangement of the elevator car with respect to the truss 110, the car 130 may be provided with a through hole 131 penetrating in a vertical direction, and the car 130 is arranged around the truss 110 via the through hole 131. In addition, the car 130 has an outer wall 132 arranged away from the truss 110, wherein the outer wall 132 is made of a transparent material, and can be configured in a columnar, rectangular parallelepiped or other structural form, which can provide a better panoramic view for passengers taking the elevator. Although not shown in the figure, a plurality of car doors may be arranged around the outer wall 132, so that passengers can leave the elevator from different positions. More specifically, for example, when the elevator is installed at adjacent corners of four compartments, four car doors can be provided for it, so that different passengers can reach different compartments of the same landing via the elevator system. Furthermore, the car 130 also has an inner wall 133 arranged close to the truss 110 and cladding the through hole 131, wherein one or more elevator operation panels are arranged on the inner wall 133 to facilitate passengers to operate the elevator.

Continuing to refer to FIG. 5, a bottom beam support 151 and a vertical beam support 152 are also provided around the car 130 to support it. Among them, the bottom beam support 151 is arranged at the bottom of the car 130, and the vertical beam support 152 is arranged through the through hole 131 of the car 130 and is connected to the bottom beam support 151, thereby supporting the car 130. In addition, the upper end of the vertical beam support 152 can extend from the through hole 131 of the car 130 and be connected to the traction assembly 140, and goes up and down with the traction action of the traction assembly 14, thereby carrying the car 130 to goes up and down together. As an embodiment of the vertical beam support 152, it can be constructed as a tubular support structure; or, it can also be constructed as a "I"-shaped steel, in which the traction reverse wheels 142 of the traction assembly 140 can be pivotally connected to the vertical beam support 152 via a pivotal axis. At this time, if multiple sets of traction assemblies 140 are used, multiple sets of vertical beam supports 152 can be configured accordingly, but the numbers of the two do not necessarily correspond to each other. In some cases, in order to improve the adaptability of the system, it is sufficient to ensure that the number of vertical beam supports 152 is greater than the number of traction reverse wheels 142 of the traction assembly 140. At this time, the system can be adapted to a configuration scheme with a different number of traction assemblies 140.

Figure 6:
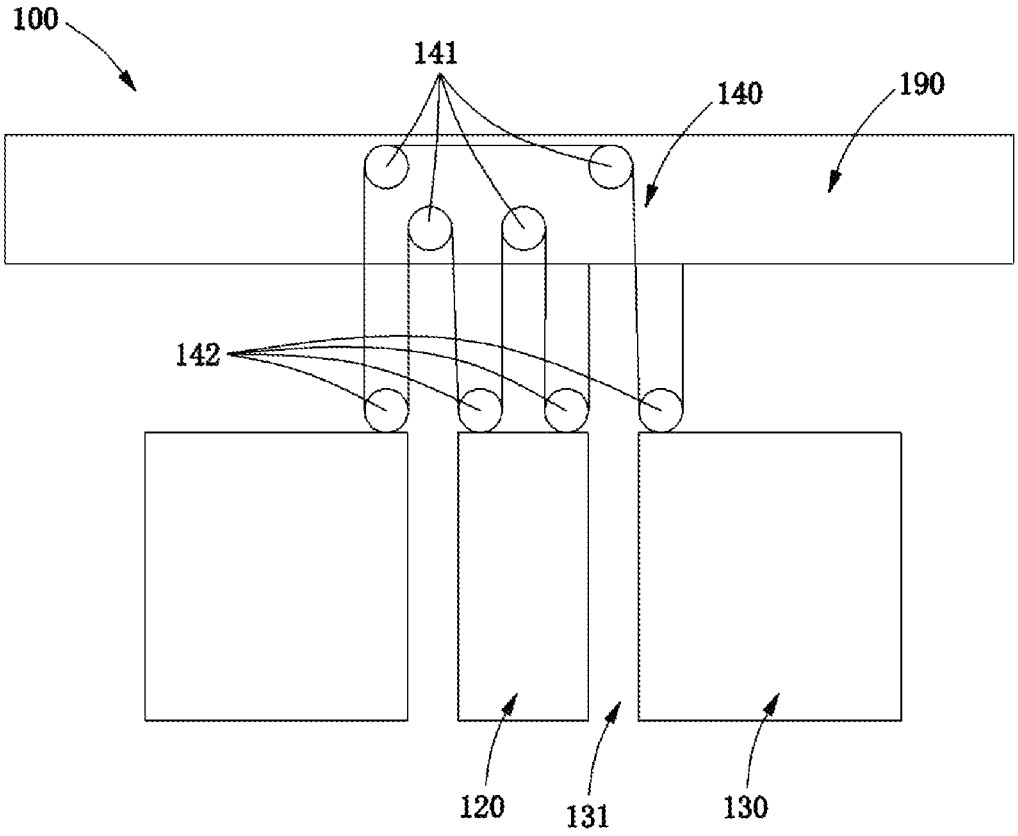
FIG. 6 is a schematic diagram of a traction assembly of an embodiment of an elevator system.
Figure 7:
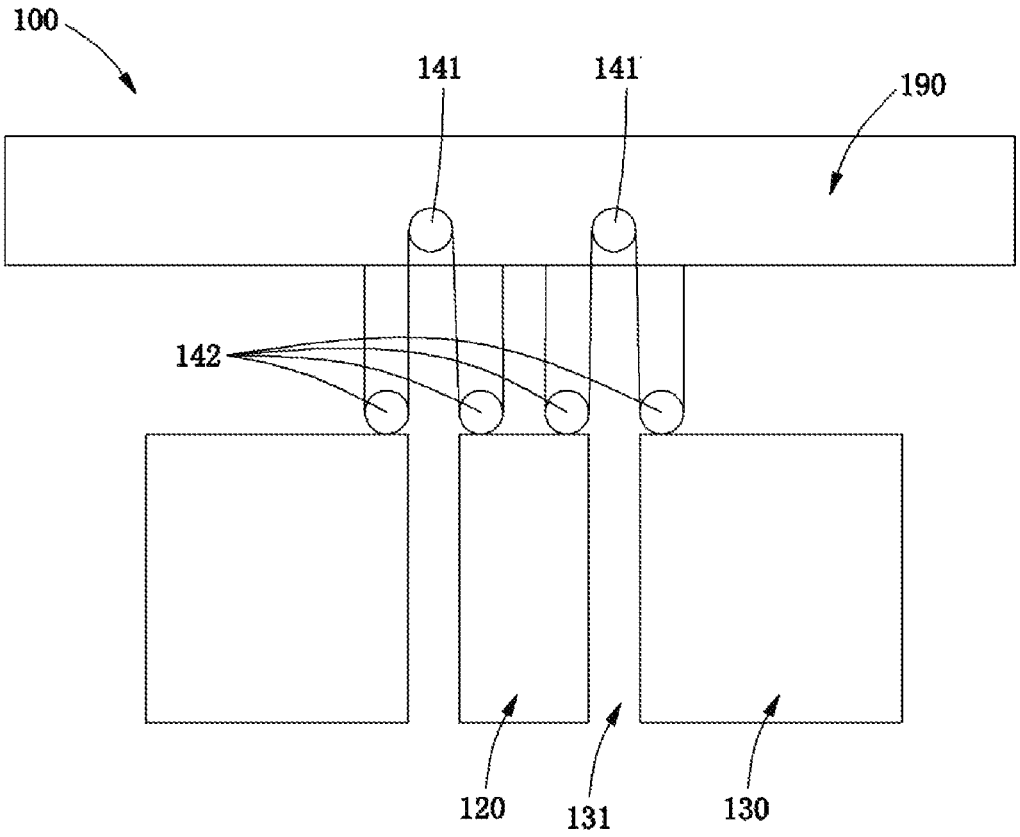
FIG. 7 is a schematic diagram of a traction assembly of another embodiment of an elevator system.
Figure 8A:
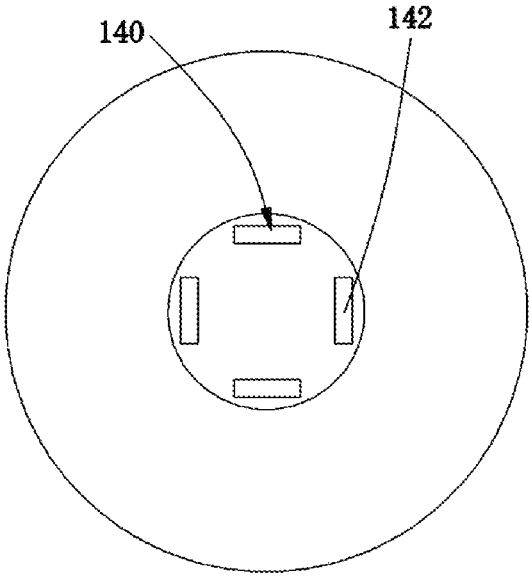
FIGS. 8*a*-8*b* are schematic top views of traction assemblies of other embodiments of an elevator system.
Figure 8B:
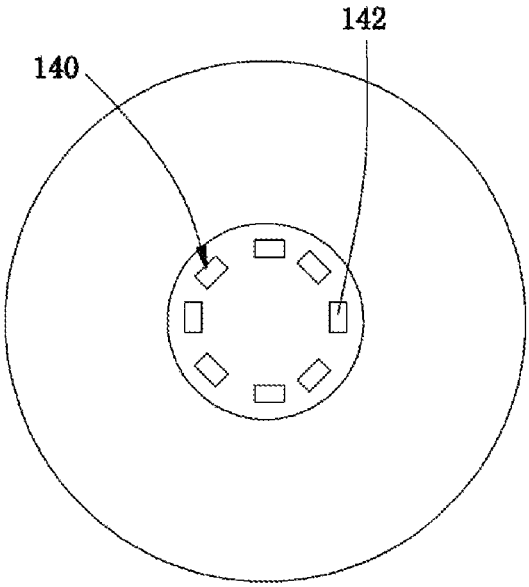

FIGS. 6 to 8 respectively show several sets of the specific arrangements and ratios of the traction assembly 140. For example, FIG. 6 shows that a traction machine is used to drive the entire traction wheel set. The traction wheel set comprises four traction fixed pulleys 141 and four traction reverse wheels 142, which are respectively arranged on the two sides of the counterweight and the two sides of the car, that is, two traction reverse wheels 142 drive the car 130 or the counterweight 120 at the same time, so a traction ratio of 4:1 is adopted. As another example, FIG. 7 shows that two traction machines are used to drive two traction wheel sets respectively. Each traction wheel set comprises one fixed traction pulley 141 and two traction reverse wheels 142, and two sets of traction assemblies 140 are symmetrically arranged on the two sides of the counterweight and the two sides of the car, that is, a traction ratio of (2:1)×2 is adopted. As still another example, FIG. 8 further expands the embodiment of FIG. 7 and shows a simplified illustration. The schemes of using four or eight traction machines to respectively drive four or eight traction wheel sets are shown schematically, each of which includes 2 traction reverse wheels, while the figure only shows that each traction wheel set is connected to one traction reverse wheel on the vertical beam support of the car. The four or eight sets of traction assemblies 140 are evenly and symmetrically arranged on the circumferential side of the counterweight and the circumferential side of the car, that is, a (2:1)×4 or (2:1)×8 traction ratio is adopted. For example, in order to realize the technical solution shown in FIG. 8*a*, two sets of the arrangements shown in FIG. 7 can be used alternately; and in order to realize the technical solution shown in FIG. 8*b*, four sets of the arrangements shown in FIG. 7 can be used alternately.

In addition, in order to better realize the installation and connection of the traction assembly and the car, the traction wheels 142 of the traction assembly 140 can be evenly arranged above the car 130 in the circumferential direction and connected to the vertical beam support 152 that supports the car 130, thereby achieving stable traction of the car.

In addition, although the elevator system is taken as an example in the foregoing embodiments for explanation, it should be understood that one aspect of the present application aims to use a support column assembly taking a truss as an example to replace the role of the dedicated elevator hoistway walls in conventional buildings. Therefore, for partially mature elevator cars and traction assemblies, the support column assembly conceived in the present application can also be directly provided for assembly. At this time, the support column assembly may include a support column such as a truss 110 and a counterweight 120 arranged in the support column such as the truss 110. The counterweight 120 can reciprocate along the length direction of the truss 110 when being hauled. Under this configuration, when the support column assembly is connected to the car and the traction assembly of a conventional elevator system, the normal functions of the elevator is also realized, thereby further improving the scope of application of the present concept.

The above examples mainly illustrate the truss assembly and the elevator system of the present application. Although only some of the embodiments of the present application are described, those skilled in the art should understand that the present application can, without departing from the spirit and scope of the invention, be implemented in many other forms. Therefore, the illustrated examples and embodiments are to be considered as illustrative but not restrictive, and the present application may cover various modifications or replacements if not departed from the spirit and scope of the present application as defined by the appended claims.

What is claimed is:

1. An elevator system, comprising:

a support column, with a bottom end thereof connected to a bottom mounting base, and a top end thereof connected to a top mounting base;

a counterweight arranged in the support column;

a car having a through hole penetrating in a vertical direction, wherein the car is arranged around the support column via the through hole;

a traction assembly, wherein the car is connected to the counterweight via the traction assembly, and the car and the counterweight reciprocate along a length direction of the support column under a traction of the traction assembly;

a bottom beam support and a vertical beam support, wherein the bottom beam support is arranged at a bottom of the car, and the vertical beam support passes through the through hole of the car and is respectively connected to the bottom beam support and the traction assembly.

2. The elevator system according to claim 1, wherein the support column is configured as a truss.

3. The elevator system according to claim 1, wherein the car has an outer wall disposed away from the support column, wherein the outer wall is made of a transparent material.

4. The elevator system according to claim 1, comprising: a plurality of the vertical beam supports, wherein the traction assembly comprises a plurality of sets of traction machines, a plurality of traction fixed pulleys and a plurality of traction reverse wheels, and wherein a plurality of the traction wheels are evenly arranged above the car in a circumferential direction and are respectively connected to the plurality of the vertical beam supports.

5. The elevator system according to claim 4, wherein a traction ratio of each set of the traction machine is 4:1 or 2:1.

6. The elevator system according to claim 1, further comprising: a car guiding element fixedly arranged between the support column and the car along the length direction of the support column, and used to guide the reciprocating movement of the car.

7. The elevator system according to claim 6, further comprising: a counterweight guiding element fixedly arranged between the support column and the counterweight along the length direction of the support column, and used to guide the reciprocating movement of the counterweight.

8. The elevator system according to claim 7, wherein the car guiding element and the counterweight guiding element are arranged crosswise on the support column.

9. The elevator system according to claim 1, further comprising: a shield arranged between the support column and the through hole of the car, cladding the support column.

10. The elevator system according to claim 1, wherein the car has an inner wall disposed close to the support column and enclosed to form the through hole, wherein one or more elevator operation panels are arranged on the inner wall.

11. The elevator system according to claim 1, wherein the car has a plurality of car doors arranged around the car.

12. An elevator system, comprising:

a support column, with a bottom end thereof connected to a bottom mounting base, and a top end thereof connected to a top mounting base;

a counterweight arranged in the support column;

a car having a through hole penetrating in a vertical direction, wherein the car is arranged around the support column via the through hole;

a traction assembly, wherein the car is connected to the counterweight via the traction assembly, and the car and the counterweight reciprocate along a length direction of the support column under a traction of the traction assembly;

a car guiding element fixedly arranged between the support column and the car along the length direction of the support column, and used to guide the reciprocating movement of the car;

a counterweight guiding element fixedly arranged between the support column and the counterweight along the length direction of the support column, and used to guide the reciprocating movement of the counterweight;

wherein the car guiding element and the counterweight guiding element are arranged crosswise on the support column;

wherein the support column has a rectangular cross section perpendicular to its length direction, and wherein the car guiding element is arranged on a short side of the rectangular cross section of the support column, extending and protruding outwardly; the counterweight guiding element is arranged on a long side of the rectangular cross section of the support column, extending and protruding inwardly.

13. A support column assembly for guiding the movement of a car in an elevator system, the support column assembly comprising:

a support column, with a bottom end thereof connected to a mounting base, and a top end thereof connected to a traction machine room; and a counterweight arranged in the support column, reciprocating along a length direction of the support column when being hauled;

wherein the car having a through hole penetrating in a vertical direction, wherein the car is arranged around the support column via the through hole;

wherein the counterweight comprises a counterweight support and a plurality of counterweight sheets, and wherein the counterweight support is arranged to carry and restrain a plurality of mutually stacked counterweight sheets.

14. The support column assembly according to claim 13, further comprising: a counterweight guiding element fixedly arranged between the support column and the counterweight along the length direction of the support column, and used to guide the reciprocating movement of the counterweight.

15. The support column assembly according to claim 13, wherein the support column is configured as a truss.

* * * * *